US008727130B2

(12) United States Patent
Otsuka

(10) Patent No.: US 8,727,130 B2
(45) Date of Patent: May 20, 2014

(54) SHEETS PROCESSING APPARATUS AND SHEETS PROCESSING METHOD

(75) Inventor: Toru Otsuka, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/562,616

(22) Filed: Jul. 31, 2012

(65) Prior Publication Data

US 2012/0310406 A1 Dec. 6, 2012

Related U.S. Application Data

(62) Division of application No. 13/158,907, filed on Jun. 13, 2011, which is a division of application No. 11/207,718, filed on Aug. 22, 2005, now Pat. No. 7,980,394.

(30) Foreign Application Priority Data

Sep. 29, 2004 (JP) ..... 2004-284308

(51) Int. Cl.
*B07C 5/00* (2006.01)

(52) U.S. Cl.
USPC ..... 209/534; 209/583; 194/206; 700/225

(58) Field of Classification Search
USPC ..... 209/552, 534, 583; 194/205–207, 194/210–217, 219, 224; 700/215, 221, 700/224–227
See application file for complete search history.

(56) References Cited

U.S. PATENT DOCUMENTS 3,759,382 A 9/1973 Walkley et al.
5,012,932 A 5/1991 Omura et al.
5,247,159 A * 9/1993 Yuge et al. ..... 235/379
5,917,930 A 6/1999 Kayani et al.
7,016,767 B2 3/2006 Jones et al.
7,103,438 B2 9/2006 Hallowell et al.
7,146,245 B2 * 12/2006 Jones et al. ..... 700/224
7,422,117 B2 9/2008 Myatt
7,505,831 B2 3/2009 Jones et al.
2002/0092801 A1 * 7/2002 Dominguez ..... 209/583
2002/0158397 A1 * 10/2002 Wilfer et al. ..... 270/52.01

FOREIGN PATENT DOCUMENTS

JP 2002-334362 11/2002
WO 2004/081886 A1 9/2004

OTHER PUBLICATIONS

Final Office Action mailed Nov. 8, 2013, in copending U.S. Appl. No. 13/158,907 (9 pages).

* cited by examiner

*Primary Examiner* — Joseph C Rodriguez
*Assistant Examiner* — Kalyanavenkateshware Kumar
(74) *Attorney, Agent, or Firm* — Pillsbury Winthrop Shaw Pittman, LLP

(57) ABSTRACT

A sheet processing apparatus including a table to be loaded a first and a second banknote group partitioned by a header card recording the bar code number in the piling direction of the banknotes, a take-in portion to take in the banknotes of the first and second banknote groups loaded on the table and the header card, a discrimination portion to count the banknotes taken in by the take-in portion and discriminate the kind thereof, a plurality of stackers to sort and stack the banknotes discriminated by the discrimination portion on the basis of the kink thereof, and a sensor to detect the header card taken in by the take-in portion. The sheet processing apparatus additionally includes a controller to control so as to stop the taking-in of the second banknote group on the basis of detection of the header card by the sensor and after a lapse of a predetermined time, to start the taking-in of the second banknote group.

10 Claims, 6 Drawing Sheets

SHEETS PROCESSING APPARATUS AND SHEETS PROCESSING METHOD

CROSS REFERENCE TO RELATED APPLICATION

This application is a divisional of U.S. application Ser. No. 13/158,907, filed Jun. 13, 2011, which is a divisional of U.S. application Ser. No. 11/207,718, filed Aug. 22, 2005, now U.S. Pat. No. 7,980,394 and for which priority is claimed under 35 U.S.C. §121. This application is based upon and claims the benefit of priority from the prior Japanese Patent Application No. 2004-284308 filed on Sep. 29, 2004, the entire contents of all applications are incorporated herein by reference in their entireties.

FIELD OF THE INVENTION

The present invention relates to a sheets processing apparatus and a sheets processing method applied, for example, as a banknotes sorter for counting sheets such as banknotes and sorting and stacking them according to the kind thereof.

DESCRIPTION OF THE BACKGROUND

In such a banknotes sorter, banknotes sent in a bag or an envelope are taken out from the bag or envelop and are set in a take-in portion. The set banknotes are taken out one by one and are sent to a discrimination portion. Here, the banknote kind is decided, and decision results are added up, thus the sum of money is obtained.

Counted banknotes are, for example, paying-in cash to a bank from a bank customer such as a supermarket and a paying-in slip is accompanied by. Or, on the bag or envelope, information such as an account number and a sum of money is recorded. The banknotes sorter compares and confirms the counted results of banknotes and the sum of money of the paying-in slip by the bag or envelope.

Conventionally, as a method for counting for each payment, there is a method available for opening a bag or an envelope for each payment, taking out banknotes, setting the banknotes in a take-in portion, inputting the contents of the paying-in slip, thereby performing the counting process.

However, in this method, while an operator of the apparatus opens a bag or an envelope and sets banknotes, the counter is stopped, so that a problem arises that the throughput is reduced.

Therefore, as disclosed in Japanese Patent Application Publication No. 2002-334362, a separator card having a number registering the relation with the contents of the paying-in slip beforehand printed in a bar code is set in the take-in portion in a state that the separator card is held between payment. The set banknotes are taken in and counted continuously and the separator card is recognized as a partition of payment. And, the bar code on the surface is read and is made correspond to the count, thus a method for obtaining an individual count may be considered.

However, in the method using a separator card, when banknotes are jammed in the conveying route, the succeeding banknotes or a separator collides with and is stacked on the jammed banknotes and the order may not be discriminated. Therefore, the payment to which the banknotes belong is not clear and a problem arises that the counting makes a mistake.

SUMMARY OF THE INVENTION

The present invention was developed with the foregoing in view and is intended to provide a sheets processing apparatus and a sheets processing method, even if sheets of a preceding sheet group are jammed in the conveying route, for preventing sheets of the succeeding sheet group partitioned by a separator card or the separator card from collision.

According to an embodiment of the present invention, there is provided a sheets processing apparatus comprising: a loading portion to be loaded a first and a second piled sheet groups partitioned by a separator card recording discrimination information in a piling direction of the sheets; take-in means for taking in the sheets of the first and second piled sheet groups loaded on the loading portion and the separator card; conveying means for conveying the sheets taken in by the take-in means; processing means for discriminating a kind of the sheets conveyed by the conveying means; a plurality of stackers to sort and stack the sheets discriminated by the processing means on the basis of the kind; detecting means for detecting the separator card taken in by the take-in means; and control means for controlling so as to stop taking-in of the second sheet group on the basis of detection of the separator card by the detecting means and after a lapse of a predetermined time, to start taking-in of the second sheet group.

Further, according to an embodiment of the present invention, there is provided a sheets processing method comprising: loading a first and a second piled sheet groups partitioned by a separator card recording discrimination information in a loading portion in a piling direction of the sheets; taking in the sheets of the first and second piled sheet groups loaded on the loading portion and the separator card; conveying the sheets taken in; discriminating a kind of the sheets conveyed; sorting and stacking the sheets discriminated on the basis of the kind; detecting the separator card taken in and stopping the take-in of the second sheet group on the basis of detection of the separator card and starting the take-in of the second sheet group after a lapse of a predetermined time.

DETAILED DESCRIPTION OF THE EMBODIMENTS

Figure 1:
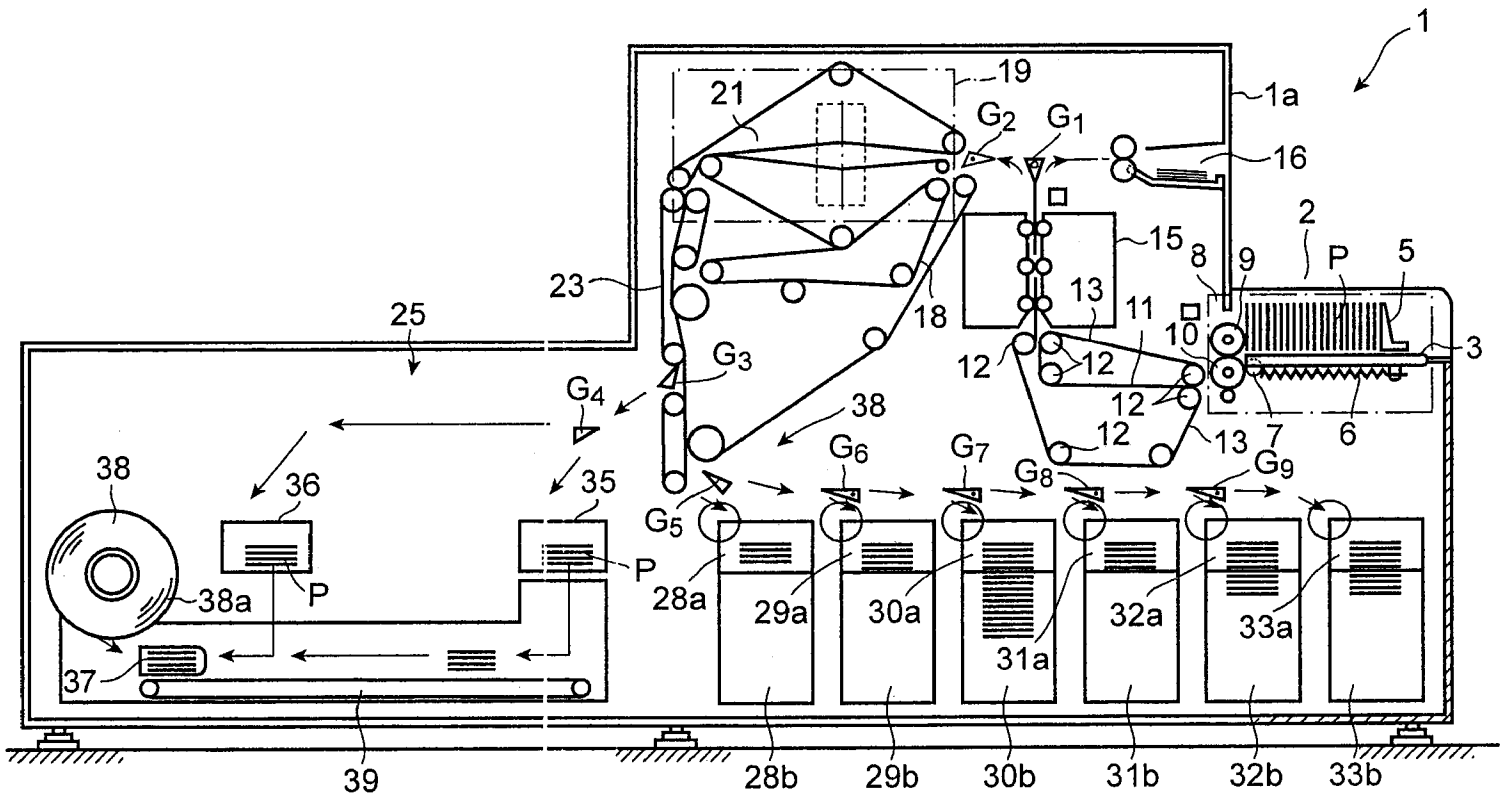
FIG. 1 is a front view showing the banknotes sorter relating to an embodiment of the present invention.

Hereinafter, the present invention will be explained in detail with reference to the embodiment shown in the accompanying drawings. FIG. 1 shows schematically the internal constitution of banknotes sorter 1 as a sheet processing apparatus relating to an embodiment of the present invention.

Banknotes sorter 1 has main body 1*a* and on one side of main body 1*a*, insert port 2 for inserting banknotes (hereinafter, may be referred to as bills) P as sheets is installed. On insert port 2, table 3 as a loading portion for loading a plurality of piled banknotes Pa inserted in an upright condition is installed. On table 3, pressing plate 5 for pressing out piled banknotes Pa is installed and pressing plate 5 is elastically pressed by spring member 6. In the pressing direction of piled banknotes Pa, take-in portion 8 as a take-in means for taking in banknotes P is installed. Take-in portion 8 is composed of feed out roller 9, pick-up roller 10, and separation roller 7.

Banknotes P picked up by pick-up roller 10 are conveyed in first conveying route (conveying means) 11. First conveying route 11 is composed of a plurality of rollers 12 and conveying belt 13 stretched over rollers 12. On the banknote conveying-out side of first conveying route 11, processor 15 as a processing means for discriminating the money kind, front and back, and truth and falsehood of banknotes P is installed. On the conveying-out side of processor 15, first switching gate G1 for switching normal banknotes in the first direction and reject banknotes in the second direction is installed. The reject banknotes sent in the second direction are collected in reject box 16. In the first direction switched by first switching gate G1, second switching gate G2 is installed. By second switching gate G2, the conveying direction of banknotes is switched to the third and fourth directions. In the third direction, second conveying route 18 for conveying front banknotes is installed. In the fourth direction, third conveying route 21 for conveying back banknotes and reversing them at reversing portion 19 is installed.

Second conveying route 18 and third conveying route 21 are joined at joining portion 23. On the banknote conveying-out side of joining portion 23, third switching gate G3 is installed. Third switching gate G3 switches the banknote conveying direction to bundling portion 25 and stacking portion 26. On stacking portion 26, a plurality of stackers 28*a* to 33*a* are arranged horizontally. Under the plurality of stackers 28*a* to 33*a*, cassettes 28*b* to 33*b* for storing stacked banknotes are arranged. Further, above the plurality of stackers 28*a* to 33*a*, fifth to ninth switching gates G5 to G9 for guiding banknotes to stackers 28*a* to 33*a* for each banknote kind are arranged.

On bundling portion 25, fourth switching gate G4 for switching the banknote conveying direction to the fifth and sixth directions is installed. In the fifth direction, first stacker 35 is installed and in the sixth direction, second stacker 36 is installed. Under first and second stackers 35 and 36, conveyor 39 for conveying banknotes stacked on first and second stackers 35 and 36 to bundling position 37 is installed. Conveyor 39 is composed of a belt conveyor or a moving tray. In the neighborhood of bundling position 37, supply reel 38 for supplying a bundling tape is installed.

Next, the processing operation of banknotes sorter 1 aforementioned will be explained.

Firstly, by a controlling unit (not drawn) of the banknotes sorter, the counting classification processing mode or bundling processing mode is set.

Figure 2:
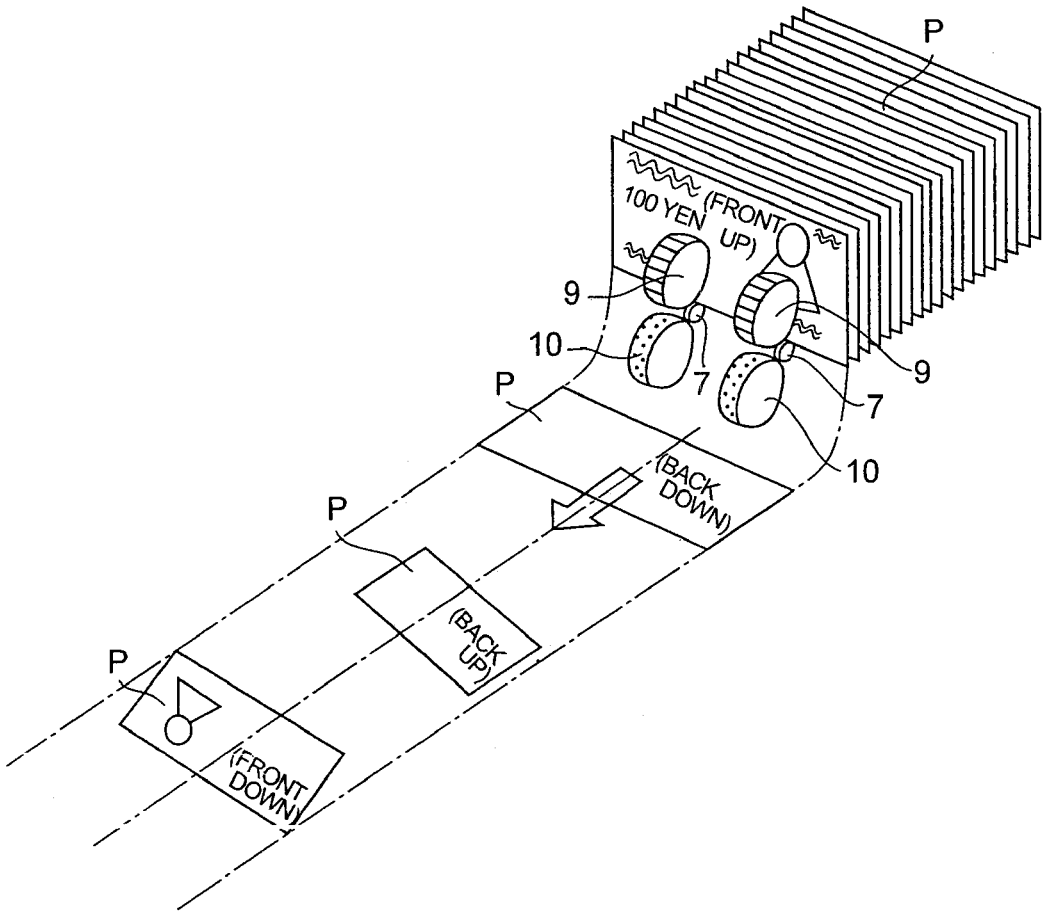
FIG. 2 is a perspective view showing the banknote take-in operation of the banknotes sorter shown in FIG. 1.

In this state, feed out roller 9, pick-up roller 10, and separation roller 7 of take-in portion 8 are driven to rotate. By doing this, banknotes P are taken in and supplied one by one as shown in FIG. 2. Banknotes P are sent to and discriminated by discrimination portion 15 via first conveying route 11. Banknotes P discriminated by discrimination portion 15 to be rejected are conveyed to reject box 16 via first switching gate G1. Banknotes P discriminated as normal banknotes by discrimination portion 15 and discriminated not to be reversed are sent to second conveying route 18 via second switching gate G2 and then are conveyed. Banknotes P discriminated as normal banknotes by discrimination portion 15 and discriminated to be reversed are sent to third conveying route 21 via second switching gate G2 and then are reversed and conveyed. These banknotes P pass joining portion 23 and are conveyed toward third switching gate G3.

By the controlling unit aforementioned, for example, when the counting classification processing mode is set, by the switching operation of third switching gate G3, banknotes P are conveyed toward stacking portion 26 and by the switching operation of switching gates G5 to G9, are sorted and stacked in stackers 28*a* to 33*a* according to the banknote kind thereof. When a predetermined number of banknotes are stacked in stackers 28*a* to 33*a*, the stacked banknotes are pushed and stored in cassettes 28*b* to 33*b* by a pushing mechanism not shown.

Further, when the bundling processing mode is set by the controlling unit, by the switching operation of third switching gate G3, the banknotes are conveyed toward fourth switching gate G4 of bundling portion 25 and by the switching operation of switching gate G4, are stacked in first stacker 35 or second stacker 36. When a predetermined number of banknotes P is stacked in first stacker 35 or second stacker 36, stacked banknotes P are conveyed to bundling position 37 by conveyor 39 and are bundled by bundling tape 38*a*.

Figure 3:
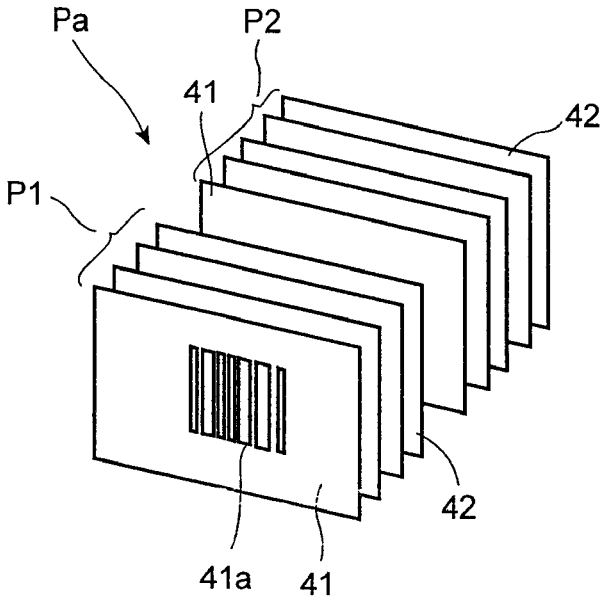
FIG. 3 is a perspective view showing a piled banknote group inserted into an insert port of the banknotes sorter shown in FIG. 1.

FIG. 3 shows piled banknotes Pa set in a standing position on table 3 of insert port 2 aforementioned.

Piled banknotes Pa are composed of first banknote group P1 as a first piled banknote group and second banknote group P2 as a second piled banknote group. The interval between first banknote group P1 and second banknote group P2 is partitioned by header card 41 and trailer car 42 as separator cards. On header card 41, bar code 41*a* as discrimination information of a unique number is printed. Further, also on trailer card 42, a bar code may be printed similarly to header card 41. Or, to distinguish trailer card 42 from banknotes, it may have a different color from that of banknotes.

Figure 4:
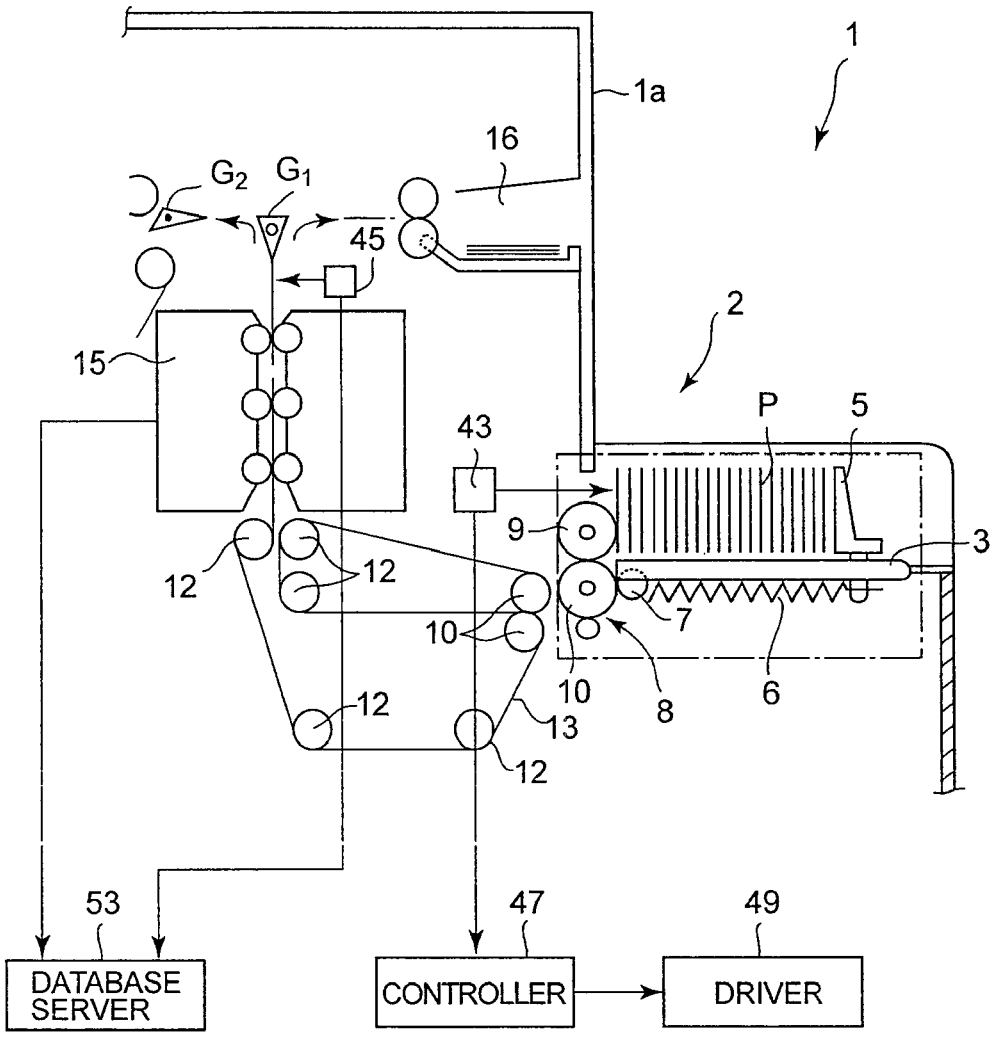
FIG. 4 is a front view showing the arrangement constitution of a sensor and a bar code reader of a header card of the banknotes sorter shown in FIG. 1.

In the neighborhood of take-in portion 8, as shown in FIG. 4, sensor 43 as a detecting means for optically detecting trailer card 42 is installed. Sensor 43 is connected to controller 47 as a controlling means via a signal circuit. To controller 47, driver 49 of take-in portion 8 is connected via the control circuit.

On the banknote ejection side of discrimination portion 15, bar code reader 45 as a reading means for reading bar code 41*a* of header card 41 is installed. Bar code reader 45 and discrimination portion 15 are connected to data base server 53, which will be described later, via a transmission circuit.

Figures 5A, 5B, 5C:
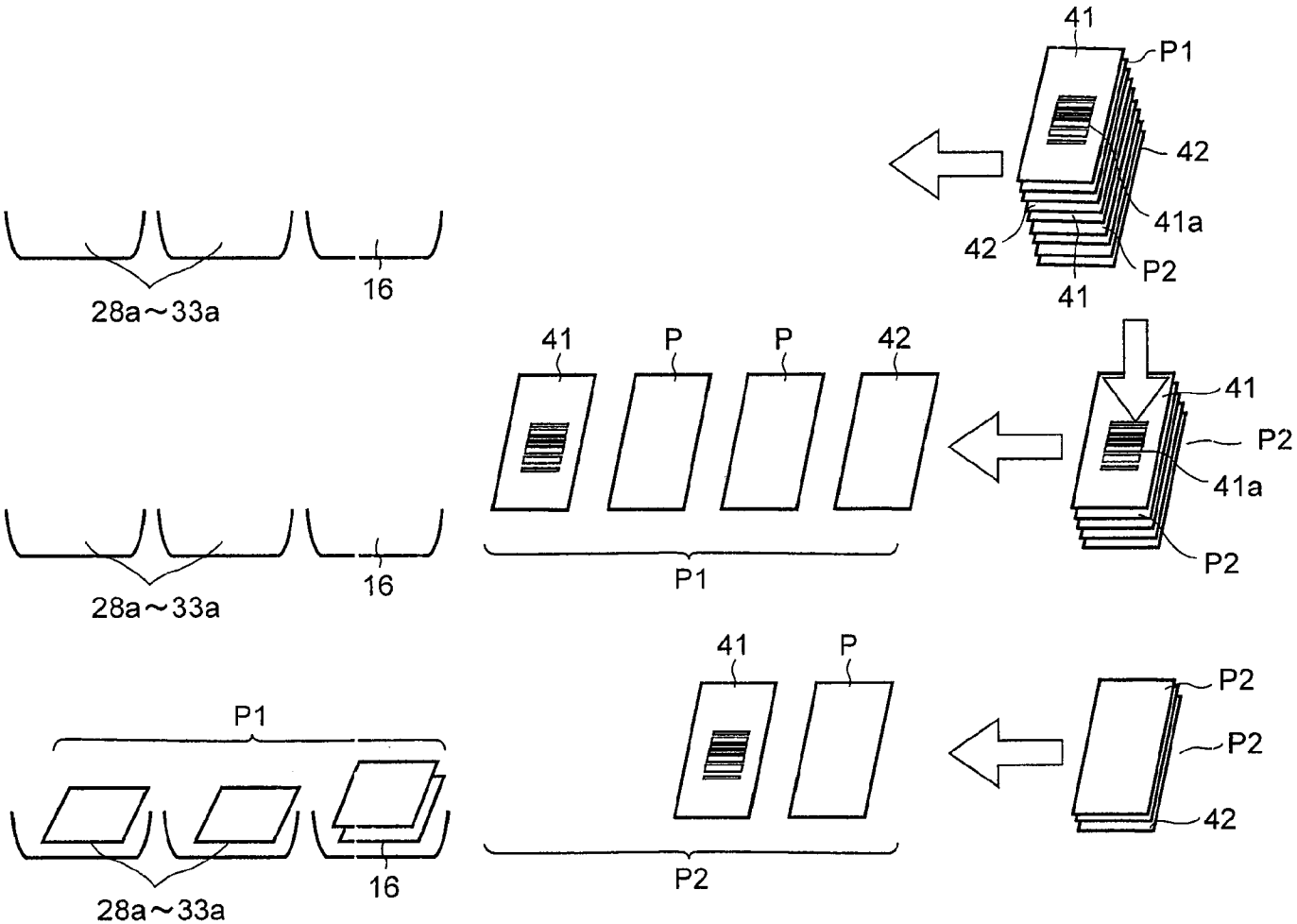
FIG. 5 is schematic block diagrams showing the condition of banknotes taken in from the take-in portion of the banknotes sorter shown in FIG. 1.

At the time of the aforementioned take-in operation of banknotes P, when the banknotes of first banknote group P1 are taken in the state shown in FIG. 5A and as shown in FIG. 5B, header card 41 of second banknote group P2 is optically detected by sensor 43, after or before taking in header card 41, driver 49 of take-in portion 8 is stopped temporarily by controller 47 and the take-in operation of banknotes is stopped. And, as described later in detail, after a lapse of a predetermined time, as shown in FIG. 5C, the take-in operation of second banknote group P2 is restarted. Further, when trailer card 42 of first banknote group P1 is optically detected by sensor 43, it is possible to temporarily stop driver 49 and stop the take-in operation of banknotes. And, after a lapse of a predetermined time, as shown in FIG. 5C, the take-in operation of second banknote group P2 may be restarted.

Further, after header card 41 taken in passes discrimination portion 15, the bar code number as discrimination information thereof is read by bar code reader 45. Header card 41 is conveyed to reject box 16 via first switching gate G1. When banknotes P taken in following header card 41 are discriminated to be rejected by discrimination portion 15, they are conveyed to reject box 16 and the banknotes are stacked on the corresponding header card 41.

Further, the data such as the sum of money and number of banknotes of first banknote group P1 processed by discrimination portion 15 is written into database server 53, which will be described later, in correspondence to the header card number.

Figure 6:
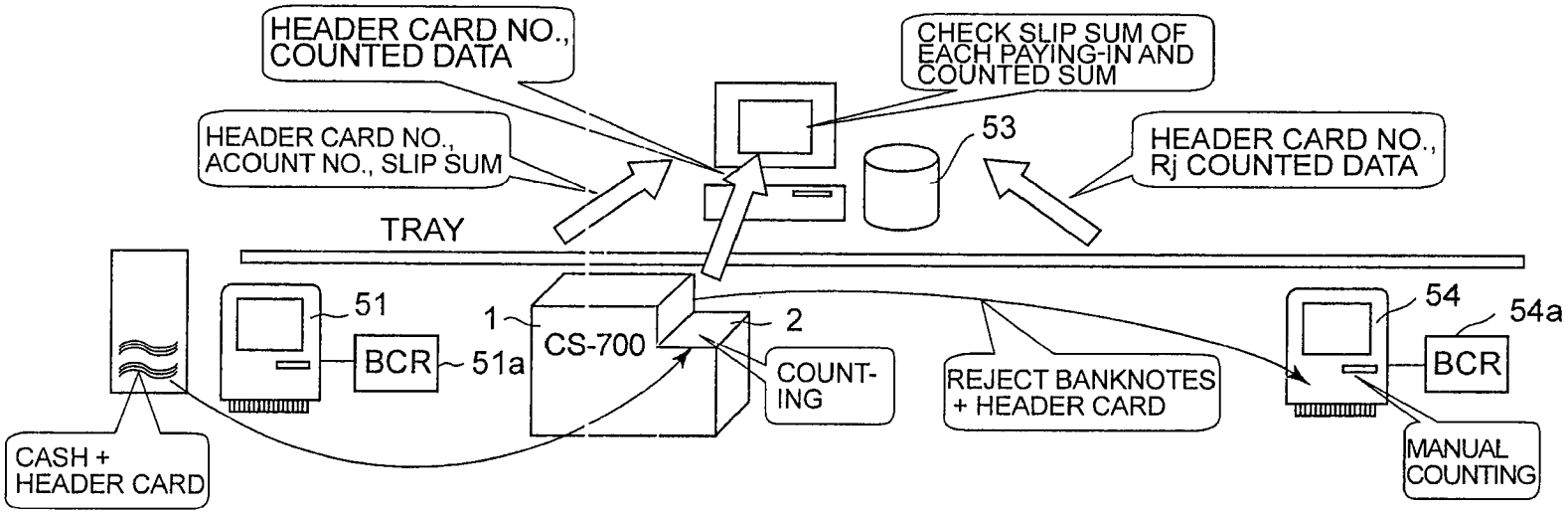
FIG. 6 is a schematic block diagram showing a processing system of the header car used by the banknotes sorter shown in FIG. 1.

FIG. 6 is a block diagram showing the processing system of the header card.

The processing system has standby station 51 and standby station 51 is connected to database server 53 via a signal circuit. To database server 53, banknote sorter 1 aforementioned is connected and reject data manual input station 54 is also connected.

Standby station 51 reads the header card number by bar code reader 51*a*, inputs the account number (the bar code may be used), slip sum, and number of paying-in banknotes, transmits the data to database server 53, and inputs the operator number.

Banknote sorter 1, as described above, executes counting of banknotes, sorting of the banknote kind, adjusting of the direction, bundling, reading of the header card (during conveyance), and transmission of data to database server 53.

Reject data manual input station 54 executes reading and manual input of the header card number, input of the number of banknotes, and input of false banknote information (when a banknote is false, the effect is registered).

Database server 53 has a database function, an addition and check function, and a printing function.

The database function, using the header card number as a key, preserves the following data.

Namely, the database function preserves the account number, slip sum, number of mechanically counted banknotes, number of manually input banknotes, number of false banknotes, and comments.

The addition and check function adds a plurality of times of the number of mechanically counted banknotes and the number of manually input banknotes and checks the result with the slip sum.

The printing function prints the result of addition and check.

Next, the processing operation procedure of the header card aforementioned will be explained.

Firstly, the operator, in standby station 51, takes out first header card 41 from the card storage portion and reads the number of header card 41 by bar code reader 51*a*. Hereafter, he opens a paying-in bag sent from a customer, takes out the banknote group, holds the banknote group between first header car 41 aforementioned and trailer card 42, and loads the banknote group on table 3 of insert port 2 of banknote sorter 1 in a standing position.

Then, he inputs the account number (or envelope number) and sum of money recorded on the slip of the paying-in bag by standby station 51. He repeats the operation until table 3 is filled up. The data input by standby station 51 is transmitted and registered in database server 53.

After the preparation by standby station 51 is finished in this way, banknote sorter 1 is operated. The operation of banknote sorter 1 is as described above and the counting data and header card number are transmitted to and registered in database server 53.

On the other hand, reject banknotes rejected in reject box 16 are sequentially stored in a tray not drawn, which is prepared separately, so as not to disturb the order with header card 41. And, the reject banknotes stored in the tray are set again on table 3 of banknote sorter 1 and are taken in. The counting data obtained by this process and header card number are transmitted to and registered in database server 53.

Further, banknotes rejected again during the aforementioned processing operation of the reject banknotes are input by manually counting by reject data manual input station 54. At this time, the header card number is simultaneously read by bar code reader 54*a*.

When the processing of all reject banknotes is finished in this way, database server 53 performs the counting addition start operation. By doing this, the data registered in database server 53 is added for each account number using the header card number as a key and the counting value is calculated.

On the other hand, during the aforementioned banknote take-in operation, when header card 41 is optically detected by sensor 43, the banknote take-in operation is stopped, and after a lapse of a predetermined time, the banknote taking-in operation is restarted, though the take-in restart condition is one of the following.

1) Restarting after the banknotes of first banknote group P1 are all conveyed to and stacked on stackers 28*a* to 33*a*.

2) Restarting after the banknotes of first banknote group P1 are all conveyed to and stacked on stackers 28*a* to 33*a* and then the physical operation such as storage in cassettes 28*b* to 33*b* and the process such as preservation of counts are completed.

3) Restarting, when the conveying route branches at switching gate G3, after the time longer than the difference in the arrival time of banknotes between from take-in portion 8 to farthest stacker 36 and from take-in portion 8 to nearest stacker 28*a* elapses. By doing this, even if the last banknote of first banknote group P1 is conveyed to farthest stacker 36 and the first banknote of second banknote group P2 is conveyed to nearest stacker 28*a*, the banknotes remaining on the conveying route can be all set only to the banknotes of second banknote group P2.

4) Restarting after the interval between the last banknote of first banknote group P1 and the first banknote of second banknote group P2 is at a distance which can be visually seen easily.

5) Restarting when the banknotes of first banknote group P1 are all counted.

Further, it is difficult to precisely detect the header card by a specific means of magnetism transmitting paper, so that it is necessary to use optical reflection of infrared light, for example, detect the reflection amount at several points, thereby surely distinguish the header card from banknotes.

As described above, according to this embodiment, on the basis of detection of header card 41 partitioning between first banknote group P1 and second banknote group P2, the take-in of banknotes is interrupted and after a lapse of a predetermined time, the take-in is restarted. Therefore, even if the banknotes of first banknote group P1 are jammed on the conveying route, the banknotes taken in from second banknote group P2 will not collide with the jammed banknotes of first banknote group P1.

Therefore, the order of the banknotes taken in from first banknote group P1 and the banknotes taken in from second banknote group P2 will not become obscure. Therefore, the payment to which the banknotes belong will not become obscure and the counting can be surely prevented from an error.

According to the present invention, even if the sheets of a preceding sheet group are jammed on the conveying route, the sheets of the succeeding sheet group or the separator card will not collide with them and there is an advantage of accurate counting.

Further, the present invention is not limited to one embodiment aforementioned and within the scope of the object thereof, needless to say, the present invention can be modified variously.

What is claimed is:

1. A banknotes processing system comprising:

a loading portion for loading a first and a second banknote group in a state in which the first and second banknote groups are piled up against each other, the first separator card is positioned at either a leading end or a trailing end of the first banknote pile group along the piling direction, and the second separator card is positioned at either a leading end or a trailing end of the second banknote pile group along the piling direction, and the first and the second separator cards contain discrimination information associated with the first and second banknote pile groups, respectively;

a take-in portion for taking in the first separator card, the first banknote pile group, the second separator card, and the second banknote pile group in order from either the leading end or the trailing end of the pile of sheets and cards along the piling direction;

a conveyor for conveying the first separator card, the first banknote pile group, the second separator card, and the second banknote pile group taken in by the take-in portion;

a processor configured to individually count the banknotes in the first and second banknote pile groups conveyed by the conveyor and to generate counting data for distinguishing between types of banknotes and for discriminating as to whether any of the banknote should be rejected;

a reader for reading the discrimination information of the first and second separator cards conveyed by the conveyor;

a reject area for accumulating the first and second separator cards read by the reader and for accumulating the banknotes discriminated as being rejected by the processor;

a database server communicatively coupled to the reader, which, in use, receives the discrimination information of the first and second separator cards from the reader and stores the received discrimination information in association with counting data of an associated one of the banknote pile groups;

a counting value calculator for receiving counting value data of the first and second banknote groups respectively counted by the processor; and a bundling portion for bundling the banknotes conveyed conveyed by the conveyor, the bundling portion including at least a first stacker and a second stacker for sorting and stacking the banknotes conveyed by the conveyor and distinguished by the processor based on banknote type, wherein the first stacker and the second stacker of the bundling portion are configured to alternately receive a predetermined number of banknotes, and when the banknotes stacked in the first stacker has reached the predetermined number, the first stacker banknotes are conveyed to the bundling portion and bundled, while at that time the second stacker starts to receive subsequent banknotes conveyed by the conveyor, and wherein, to reconcile a count of the rejected banknotes, the rejected banknotes are further processed by:

removing the first and second separator cards and the rejected banknotes accumulated in the reject area, reloading, onto the loading portion, the rejected banknotes and the first separator card, or the second separator card, or the first and second separator cards that correspond to the accumulated rejected banknotes, taking in the rejected banknotes and the corresponding separator card(s) by the take-in portion, rereading, by the reader, the card discriminating information of the corresponding separator card(s) taken in by the take-in portion, individually recounting the rejected banknotes taken in by the take-in portion to generate counting addition data, and adding the counting addition data to the previous counting data of the non-rejected banknotes using the card discrimination information as a key to update the counting data.

2. The system according to claim 1, further comprising a printer for printing the result of addition and check.

3. The system according to claim 1, wherein a counting process of the second pile banknote group is executed after the second separator card has been detected by a sensor.

4. The system according to claim 1, wherein the first and second separator cards have a different color from that of the banknotes.

5. The system according to claim 1, wherein the loading portion comprises a pressing plate for elastically pressing the banknote pile group and the first and second separator cards.

6. The system according to claim 1, wherein the reader comprises a bar code reader.

7. A banknote processing method, comprising:

loading a first and second banknote pile groups on a loading portion in a state in which the first and second banknote groups are piled up against each other, either a leading end or a trailing end of the first banknote pile group along the piling direction, and the second separator card is positioned at either a leading end or a trailing end of the second banknote pile group along the piling direction, and the first and second separator cards contain discrimination information associated with the first and second banknote pile groups, respectively;

taking in the first separator card, the first banknote pile group, the second separator card, and the second banknote pile group in order from either the leading end or the trailing end of the pile of the sheets and cards along the piling direction;

conveying, by a conveyor, the first separator card, the first banknote pile group, the second separator card, and the second banknote pile group taken in by the take-in function;

individually counting, by a processor, the banknotes in the first and second banknote pile groups conveyed by the conveyor to generate counting data, for distinguishing between types of banknotes and for discriminating as to whether any of the banknotes should be rejected;

reading, by a reader, the discrimination information of the first and second separator cards conveyed by the conveyor;

accumulating in a reject area the first and second separator cards read by the reading function and the banknotes discriminated as being rejected by the processor;

receiving, by a database server, the discrimination information of the first and second separator cards read by the reader and storing the received discrimination information in association with counting data of an associated one of the banknote pile groups;

calculating a counting value data of the first and second banknote groups respectively counted by the processor; and conveying the banknotes to a bundling portion, the bundling portion including at least a first stacker and a second stacker for sorting and stacking the banknotes conveyed by the conveyor and distinguished by the processor based on banknote type, wherein the first stacker and the second stacker of the bundling portion are configured to alternately receive a predetermined number of banknotes, and when the banknotes stacked in the first stacker has reached the predetermined number, the first stacker banknotes are conveyed to the bundling portion and bundled, while at that time the second stacker starts to receive subsequent banknotes conveyed by the conveyor, and wherein, to reconcile a count of the rejected banknotes, the rejected banknotes are further processed by:

removing the first and second separator cards and the rejected banknotes accumulated in the reject area, reloading, onto the loading portion, the rejected banknotes and the first separator card, or the second separator card, or the first and second separator cards that correspond to the accumulated rejected banknotes, taking in the rejected banknotes and the corresponding separator card(s), rereading, by the reader, the card discriminating information of the corresponding separator card(s) taken in by the take-in portion, individually recounting the rejected banknotes taken in by the take-in portion to generate counting addition data, and adding the counting addition data to the previous counting data of the non-rejected banknotes using the card discrimination information as a key to update the counting data.

8. The method according to claim 7, further comprising printing the result of the adding and checking.

9. The method according to claim 7, wherein processing of the second banknote pile group begins after detecting the second separator card.

10. The method according to claim 7, wherein the counting data comprises account identifying information, number of counted banknote information, and information relating to an expected total value of the associated one of the banknote pile groups, and wherein the method further comprises:

computing a monetary value of the associated one of the banknote pile groups based on the number of counted banknote information;

comparing the computed monetary value with the executed total value; and printing a result of the comparison.

* * * * *